US010724120B2

(12) United States Patent
Boyle et al.

(10) Patent No.: US 10,724,120 B2
(45) Date of Patent: Jul. 28, 2020

(54) RAPID SYNTHESIS OF GALLIUM ALLOYS

(71) Applicant: National Technology & Engineering Solutions of Sandia, LLC, Albuquerque, NM (US)

(72) Inventors: Timothy J. Boyle, Albuquerque, NM (US); LaRico Juan Treadwell, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 211 days.

(21) Appl. No.: 16/107,814

(22) Filed: Aug. 21, 2018

(65) Prior Publication Data

US 2019/0062868 A1 Feb. 28, 2019

Related U.S. Application Data

(60) Provisional application No. 62/552,702, filed on Aug. 31, 2017.

(51) Int. Cl.

| | |
|---|---|
| ***C22B 58/00*** | (2006.01) |
| ***C22B 59/00*** | (2006.01) |
| ***C22C 28/00*** | (2006.01) |
| ***C22C 24/00*** | (2006.01) |

(52) U.S. Cl.

CPC ..... *C22B 58/00* (2013.01); *C22B 59/00* (2013.01); *C22C 24/00* (2013.01); *C22C 28/00* (2013.01)

(58) Field of Classification Search

CPC ..... C22C 28/00; C22B 58/00; C22B 59/00

USPC ..... 75/610, 688

See application file for complete search history.

(56) References Cited

U.S. PATENT DOCUMENTS

2004/0048735 A1* 3/2004 Mathivet ..... B01J 31/143 502/102
2010/0240770 A1* 9/2010 Qi ..... H01L 21/02628 514/769
2012/0261624 A1* 10/2012 Peng ..... C09K 11/02 252/518.1

OTHER PUBLICATIONS

Yarema M., et al.; "Precision Synthesis of Colloidal Inorganic Nanocrystals using Metal and Metalloid Amides"; Nanoscale, 2013 (Year: 2013).*

Meng He, et al.; "A General Synthesis Strategy for Monodisperse Metallic and Metalloid Nanoparticles (In, Ga, Bi, Zn, Cu, Sn, and their Alloys) via in Situ Formed Metal Long-Chain Amides"; ACS Publications, 2014 (Year: 2014).*

Beachley, et al.; "Room Temperature Cyclopentadiene Elimination Reaction for the Synthesis of Diethylgallium—Amides—Phosphides—Thiolates. Crystal and Molecular Structures" Organometallics, 15, 3653-3658, 1996 (Year: 1996).*

* cited by examiner

*Primary Examiner* — Alexandra M Moore
*Assistant Examiner* — Austin Pollock
(74) *Attorney, Agent, or Firm* — Kevin W. Bieg

(57) ABSTRACT

The ability to generate complex gallium alloys using metal amides, $Ga(NR_2)_3$ and $M(NR_2)_n$, is easily accomplished by heating the two metal amides in predetermined ratios. The product can be isolated as $Ga_xM_y$ where x and y can vary.

4 Claims, 5 Drawing Sheets

RAPID SYNTHESIS OF GALLIUM ALLOYS

CROSS-REFERENCE TO RELATED APPLICATION

This application claims the benefit of U.S. Provisional Application No. 62/552,702, filed Aug. 31, 2017, which is incorporated herein by reference.

STATEMENT OF GOVERNMENT INTEREST

This invention was made with Government support under Contract No. DE-NA0003525 awarded by the United States Department of Energy/National Nuclear Security Administration. The Government has certain rights in the invention.

FIELD OF THE INVENTION

The present invention relates to metal alloys and, in particular, to the rapid synthesis of gallium alloys from metal amides.

SUMMARY OF THE INVENTION

The present invention is directed to a method of heating metal amides together in an inert atmosphere to synthesize a gallium alloy. The method comprises mixing a gallium amide with a rare earth metal amide; and heating the mixture to an elevated temperature in an inert environment to form an alloy comprising gallium and the rare earth metal. For example, the gallium amide can comprise gallium dimethylamide. For example, the rare earth metal amide can comprise a scandium amide, such as scandium dimethylamide.

BRIEF DESCRIPTION OF THE DRAWINGS

The detailed description will refer to the following drawings, wherein like elements are referred to by like numbers.

DETAILED DESCRIPTION OF THE INVENTION

Metal amides are a class of coordination compounds composed of a metal center with amide ligands of the form $NR_2$. The invention is directed to a method to synthesize complex gallium alloys using $Ga(NR_2)_3$ and a series of $M(NR_2)_n$ by heating the two metal amides in predetermined ratios. In general, $M(NR_2)_n$ can be any rare earth amide, including lanthanide, yttrium, and scandium amides. The final product can be isolated as $Ga_xM_y$ where x and y can vary.

Figure 1:
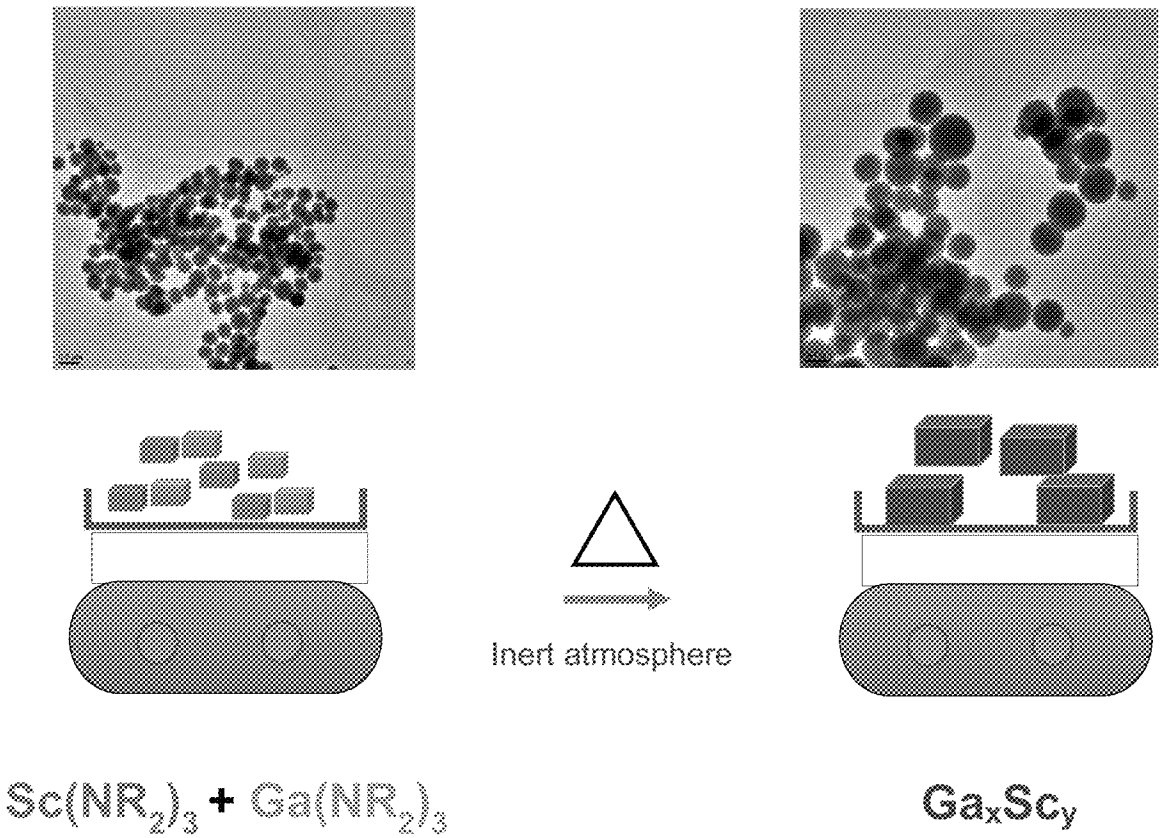
FIG. 1 is a schematic illustration of the rapid synthesis of a metal alloy by heating of metal amides in an inert atmosphere.
Figure 2:
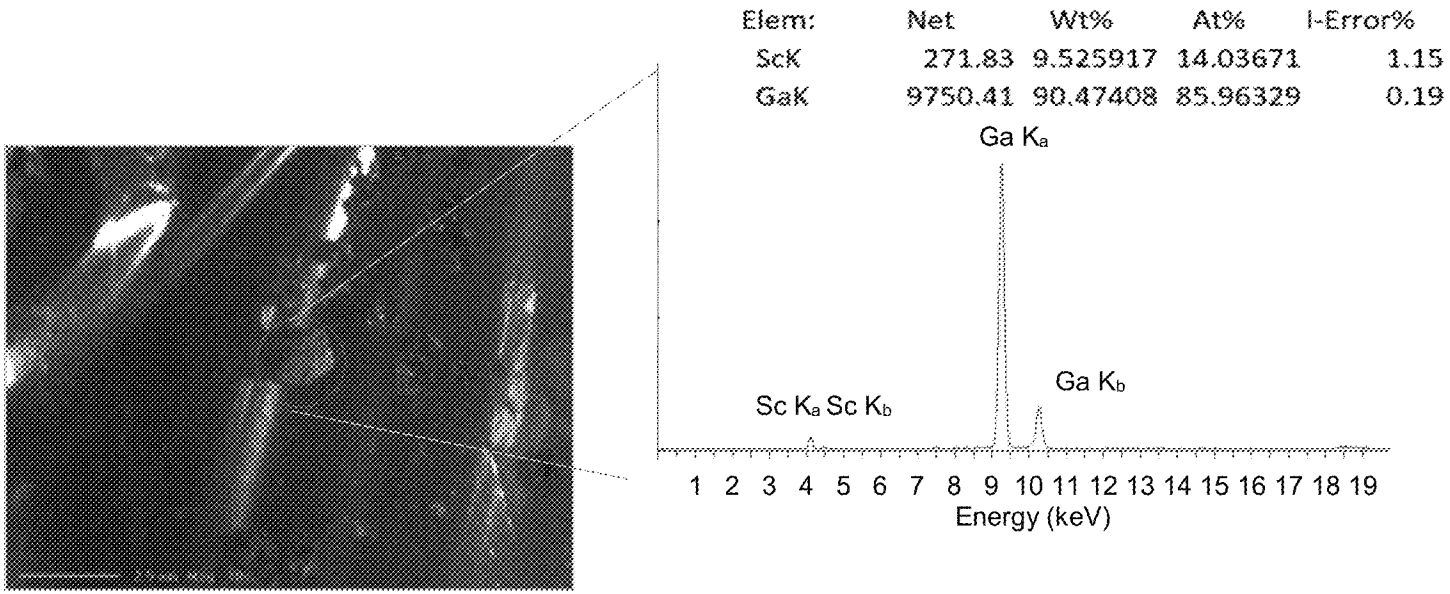
FIG. 2 is an energy dispersive X-ray spectroscopy (EDS) spectrum of a particle formed by the heating of an equimolar mixture of $Sc(NR_2)_3$ and $Ga(NR_2)_3$.
Figure 3:
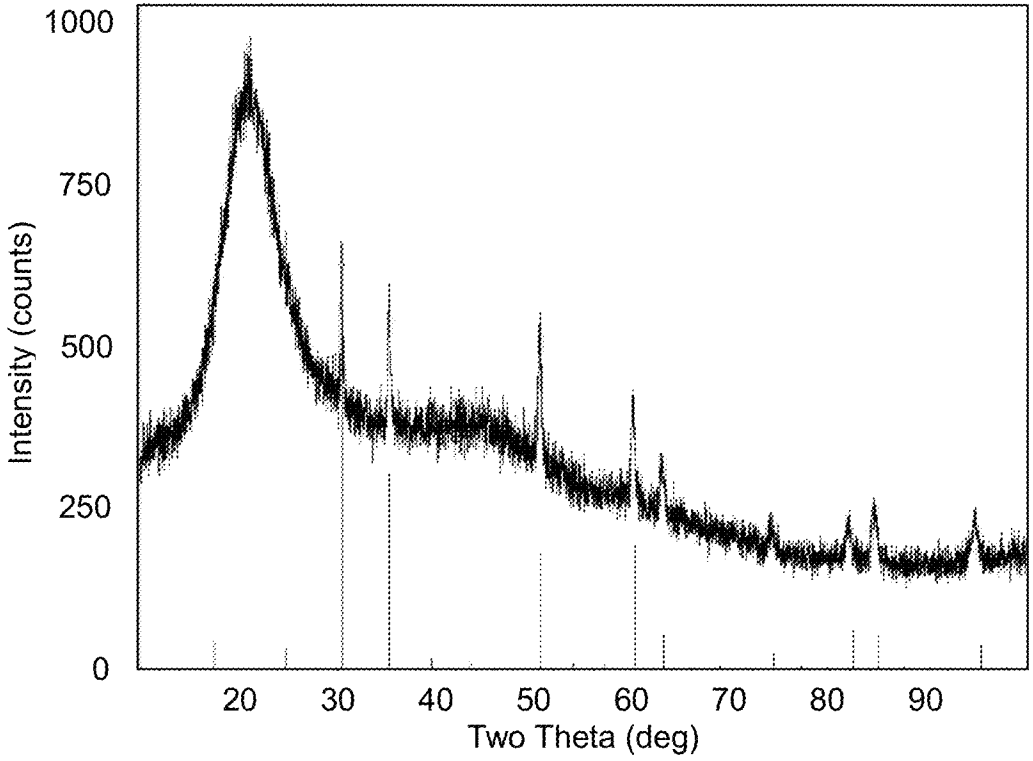
FIG. 3 is a powder X-ray diffraction (XRD) pattern of the metal alloy synthesized from an equimolar mixture of $Sc(NR_2)_3$ and $Ga(NR_2)_3$.

As an example of the invention, several $Ga_xSc_y$ alloys were generated from combinations of the metal amides, $Sc(NMe_2)_3$ and $Ga(NMe_2)_3$. An equimolar mixture of approximately 0.2 μm powders of the metal amides where placed on a hot plate at 500° C. in an inert atmosphere, as shown in FIG. 1. An elemental mapping of a scanning electron microscopy (SEM) image of the resulting bulk powder clearly showed that both elements were present over the entire particle, as shown in FIG. 2. A powder X-ray diffraction (XRD) pattern of the metal alloy product is shown in FIG. 3.

Figure 4:
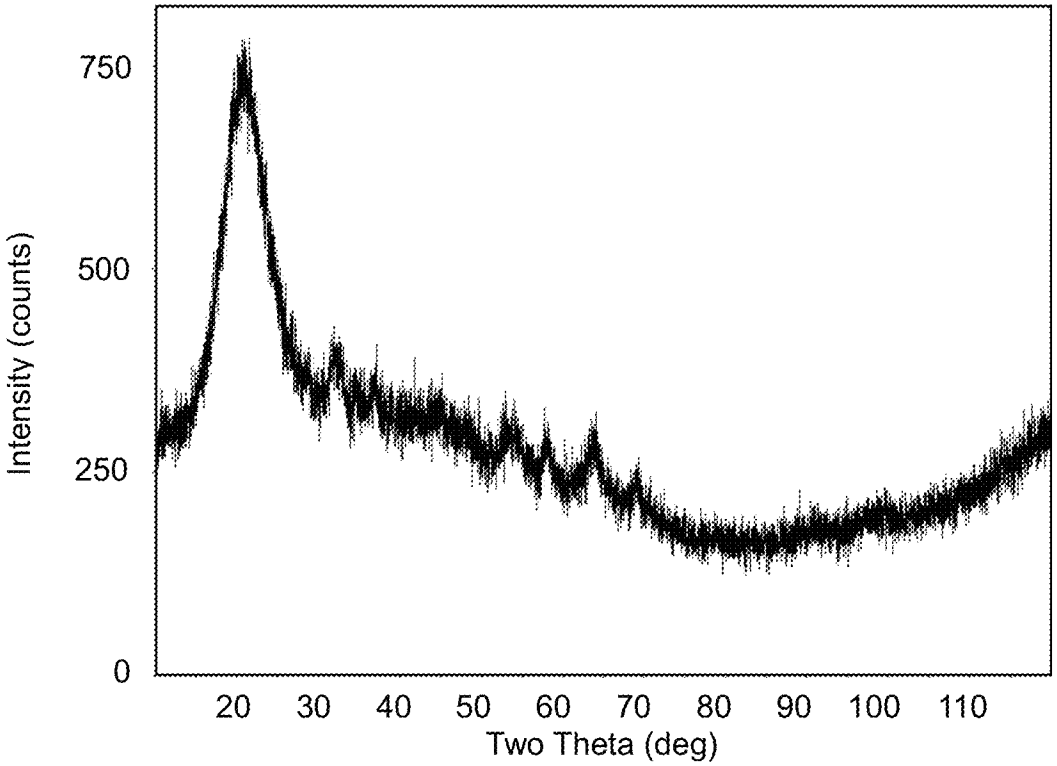
FIG. 4 is a powder XRD pattern of the metal alloy synthesized from a 1:2 mole ratio of $Sc(NR_2)_3$ and $Ga(NR_2)_3$.

In a more detailed study, a metal alloy was synthesized from a 1:2 mole ratio of the metal amides. 0.075 g of $Sc(NMe_2)_3$ and 0.171 g of $Ga(NMe_2)_3$ were weighed out and crushed together using a mortar and pestle inside an argon glove box. The powder was placed in a small bowl-shaped crucible and the crucible was placed in a vacuum Parr bomb. The Parr bomb was closed. A vacuum of −18 psi was pulled on the Parr bomb and the bomb was sealed under vacuum. The Parr bomb was heated using a heating mantle until a temperature of 450° C. was reached. The bomb was kept at this temperature for an hour. The pressure in the bomb built up to about 20 psi over the course of the thermal processing. The heat was then turned off. Once cooled, the bomb could be opened to the argon atmosphere. FIG. 4 shows an XRD pattern of the metal alloy product, indicating that a new structure type had been formed.

Figure 5:
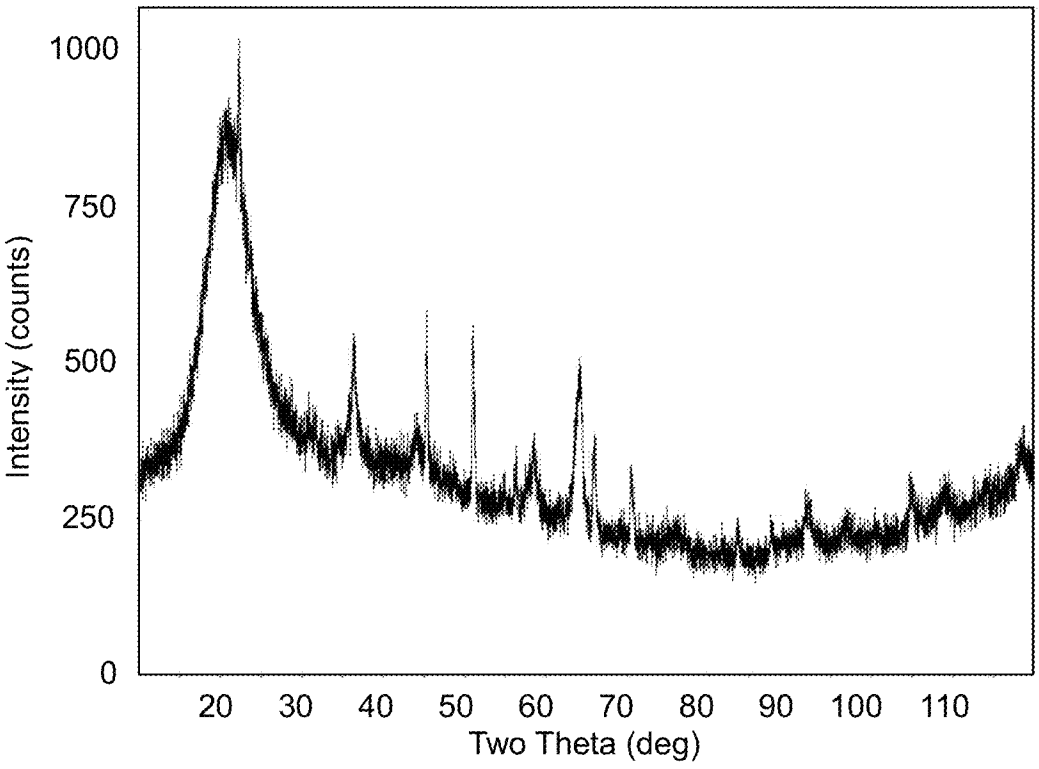
FIG. 5 is a powder XRD pattern of the metal alloy synthesized from a 1:3 mole ratio of $Sc(NR_2)_3$ and $Ga(NR_2)_3$.

Using the above procedure, a metal alloy was synthesized from a 1:3 mole ratio of the metal amides (0.05 g of $Sc(NMe_2)_3$ and 0.172 g of $Ga(NMe_2)_3$). FIG. 5 shows an XRD pattern of the metal alloy product, indicating that a new structure type had been formed.

The present invention has been described as a method for the rapid synthesis of metal alloys. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A method to synthesize a gallium alloy, comprising:
mixing a gallium amide with a rare earth metal amide; and
heating the mixture to an elevated temperature in an inert environment to form an alloy comprising gallium and the rare earth metal.

2. The method of claim 1, wherein the gallium amide comprises gallium dimethylamide.

3. The method of claim 1, wherein the rare earth metal amide comprises scandium amide.

4. The method of claim 3, wherein the scandium amide comprises scandium dimethylamide.

* * * * *